US009903596B2

(12) United States Patent
Barber et al.

(10) Patent No.: US 9,903,596 B2
(45) Date of Patent: Feb. 27, 2018

(54) BROILER SHIELD FOR A RESIDENTIAL OVEN AND RESIDENTIAL OVEN INCORPORATING SAME

(75) Inventors: Judith Barber, Trent Woods, NC (US); George May, New Bern, NC (US); Michael Penuel, Swansboro, NC (US); Kevin W. Sherbert, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 879 days.

(21) Appl. No.: 13/193,891

(22) Filed: Jul. 29, 2011

(65) Prior Publication Data

US 2013/0025580 A1 Jan. 31, 2013

(51) Int. Cl.

| | |
|---|---|
| ***F24C 15/00*** | (2006.01) |
| ***F24C 15/22*** | (2006.01) |
| ***F24C 7/06*** | (2006.01) |

(52) U.S. Cl.

CPC ..... *F24C 15/22* (2013.01); *F24C 7/06* (2013.01)

(58) Field of Classification Search

CPC . Y02E 10/44; Y02E 10/45; F24J 2/055; F24J 2/1047; F24J 2/14

USPC ..... 219/405, 411; 126/552, 686

See application file for complete search history.

(56) References Cited

U.S. PATENT DOCUMENTS

| | | | | |
|---|---|---|---|---|
| 3,456,579 | A * | 7/1969 | Woods | 99/341 |
| 5,721,805 | A * | 2/1998 | Cook et al. | 392/411 |
| 7,105,778 | B1 * | 9/2006 | DeLong et al. | 219/386 |
| 7,335,858 | B2 * | 2/2008 | Cavada et al. | 219/386 |
| 8,222,570 | B2 * | 7/2012 | Timans | 219/390 |
| 8,330,080 | B2 * | 12/2012 | Fernandez et al. | 219/392 |
| 2004/0151484 | A1 * | 8/2004 | Kaplanis et al. | 392/422 |
| 2008/0141867 | A1 * | 6/2008 | Cavada et al. | 99/332 |

* cited by examiner

*Primary Examiner* — David Angwin
*Assistant Examiner* — Amit K Singh
(74) *Attorney, Agent, or Firm* — Michael E. Tschupp; Andre Pallapies; Brandon G. Braun

(57) ABSTRACT

A broiler reflector is provided between an upper wall of a cooking cavity of a residential oven and a broiler heating element. The broiler reflector helps to direct radiant heat energy emitted upward from the broiler heating element downward towards food items located beneath the broiler heating element. The shape of the broiler reflector helps to ensure that a sufficient amount of the radiant energy is directed to the front and rear portions of an underlying rack to ensure even cooking and even browning. The broiler reflector can include a front reflecting portion and a rear reflecting portion, each of which include first and second reflectors.

18 Claims, 7 Drawing Sheets

BROILER SHIELD FOR A RESIDENTIAL OVEN AND RESIDENTIAL OVEN INCORPORATING SAME

BACKGROUND OF THE INVENTION

Many residential ovens which include electric heating elements include a broiler heating element mounted in an upper portion of a cooking cavity of the oven. The broiler heating element is activated to broil food items which are placed on an oven rack located directly underneath the broiler heating element.

A side view of the interior of such a residential oven is illustrated in FIG. 1. As shown therein, the residential oven 100 includes a rear wall 102, a lower wall 104 and an upper wall 106. A door 105 is attached to the front of the oven and the door 105 can be opened and shut using a handle 107.

The plurality of rack mounts 103 are provided on opposite sidewalls of the oven. This allows one or more racks 109 to be mounted in the interior of the oven 100 at different heights.

A lower heating element 111 is provided in a lower portion of the cooking cavity of the oven 100. In addition, a broiler heating element 110 is located in an upper portion of the cooking cavity. The broiler heating element 110 can be used in conjunction with the lower heating element 111 during a normal baking operation. Alternatively, the lower heating element 111 alone might be used during a baking operation.

During a broiling operation, the lower heating element 111 is typically turned off, and the broiler heating element 110 alone is activated. The broiler heating element 110 emits heat and radiant energy which is projected downward onto the food items located on the rack 109 located directly underneath the broiler heating element 110.

A broiler heating element 110 is typically constructed of a relatively thick resistive wire which has a circular cross sectional shape. When electricity passes through the broiler heating element 110, the electricity causes the wire to emit heat and radiant energy. The radiant energy is emitted in all directions around the circular circumference of the wire. When a broiling operation is being conducted, the radiant energy emitted from the broiler heating element browns food items on an underlying rack.

While the radiant heat which is emitted downward from the broiler heating element impinges directly on food elements located beneath the broiler heating element, radiant heat which is emitted sideways or upward does not tend to reach the food items located underneath the broiler heating element.

In addition, because of the way broiler heating elements are shaped, more heat and radiant energy tends to impinge upon the center portions of an underlying rack than the front and rear portions of the underlying rack. This can result in uneven cooking and uneven browning of food items located on an underlying rack.

BRIEF SUMMARY OF THE INVENTION

One aspect of the invention is embodied in a broiler shield which is mounted above a broiler heating element of a residential oven, and which helps to reflect radiant energy emitted upward from the broiler heating element downward towards food items placed on an underlying rack.

Some embodiments of the broiler shield have angled reflectors that are positioned relative to front and rear portions of the broiler heating element so that radiant energy is effectively distributed to the front and rear portions of an underlying rack to promote more even cooking and browning of food items on the underlying rack.

Some embodiments of the broiler shield include a front extension that extends forward and downward from a front edge of the broiler shield, the front extension reflecting radiant energy emitted sideways from the front of a broiler heating element downwards toward the front portion of an underlying rack.

DETAILED DESCRIPTION OF PREFERRED EMBODIMENTS

Figure 1:
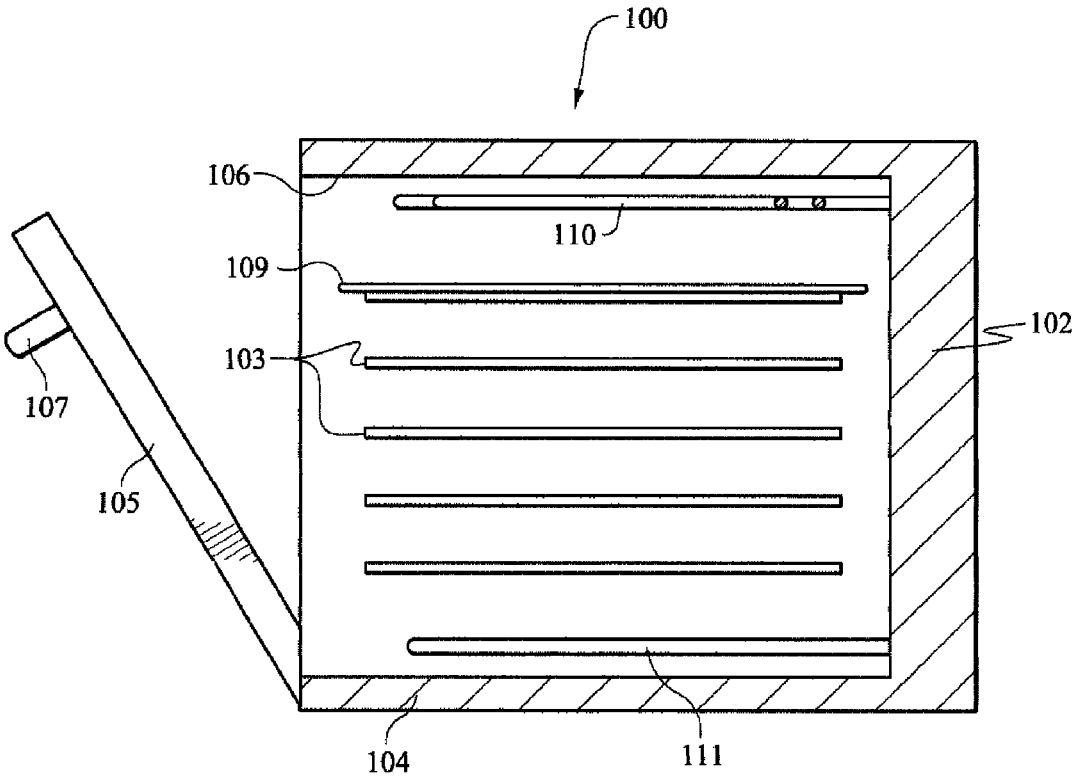
FIG. 1 is a cross-sectional view of the interior of a residential oven.
Figure 2A:
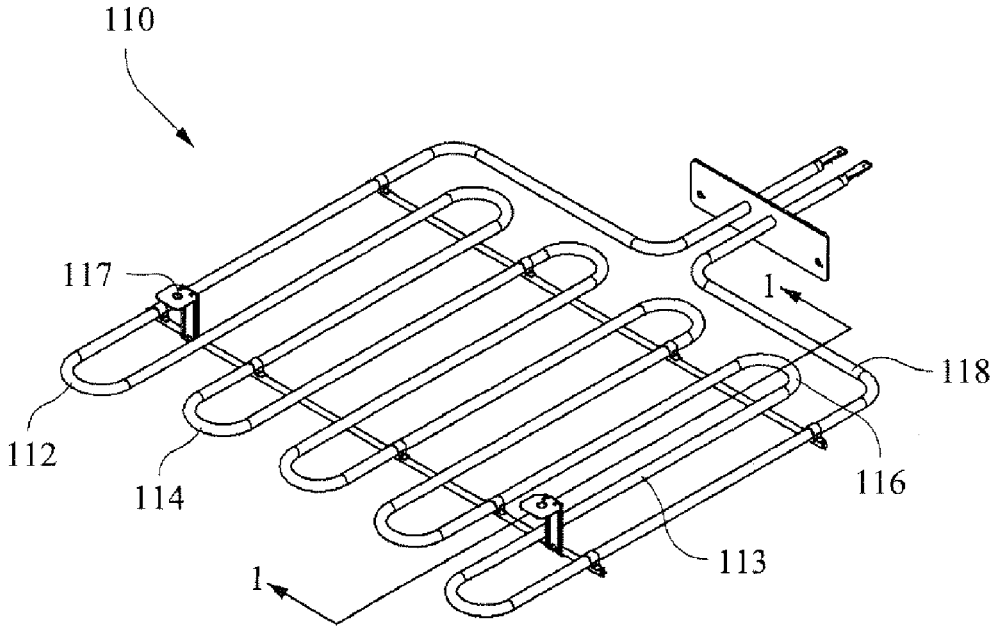
FIGS. 2A and 2B are perspective views of broiler heating elements.

FIG. 2A illustrates a first embodiment of a broiler heating element 110 which can be used in a residential oven. As shown in FIG. 2A, the broiler heating element 110 includes a connecting portion 118 which is used to couple the broiler heating element to a power supply. The broiler heating element 110 also includes front portions 114, 112 and rear portions 116 which join straight portions 113. The continuous broiler heating element traces out a repeating S-shaped pattern. In addition, mounting elements 117 can be used to attach the broiler heating element 110 to the upper wall of a cooking cavity of a residential oven. In the embodiment illustrated in FIG. 2A, the central front portions 114 do not project as far to the front of the oven as the outermost front portions 112.

Figure 2B:
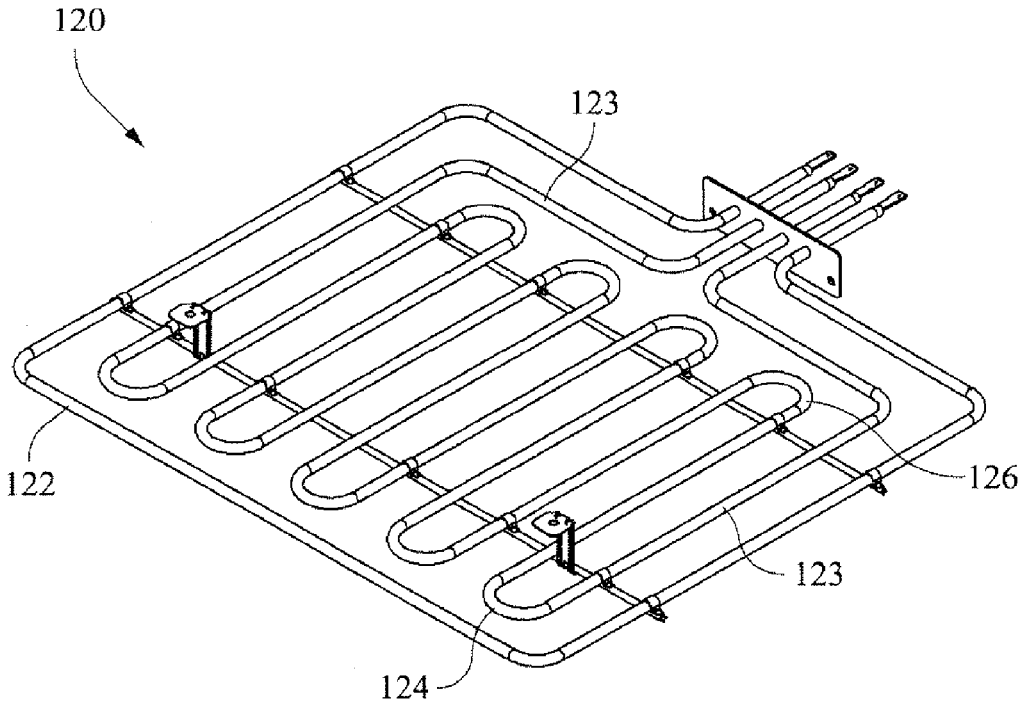

FIG. 2B illustrates another embodiment of a broiler heating element 120. In this embodiment, two separate heating elements are provided. An interior heating element 123 is located inside an exterior heating element 122. The interior heating element 123 still includes front portions 124 and rear portions 126 which join a plurality of straight portions 123. When this type of a broiler heating element is installed in an oven, the two heating elements 122, 123 can used together, or separately.

Figure 3:
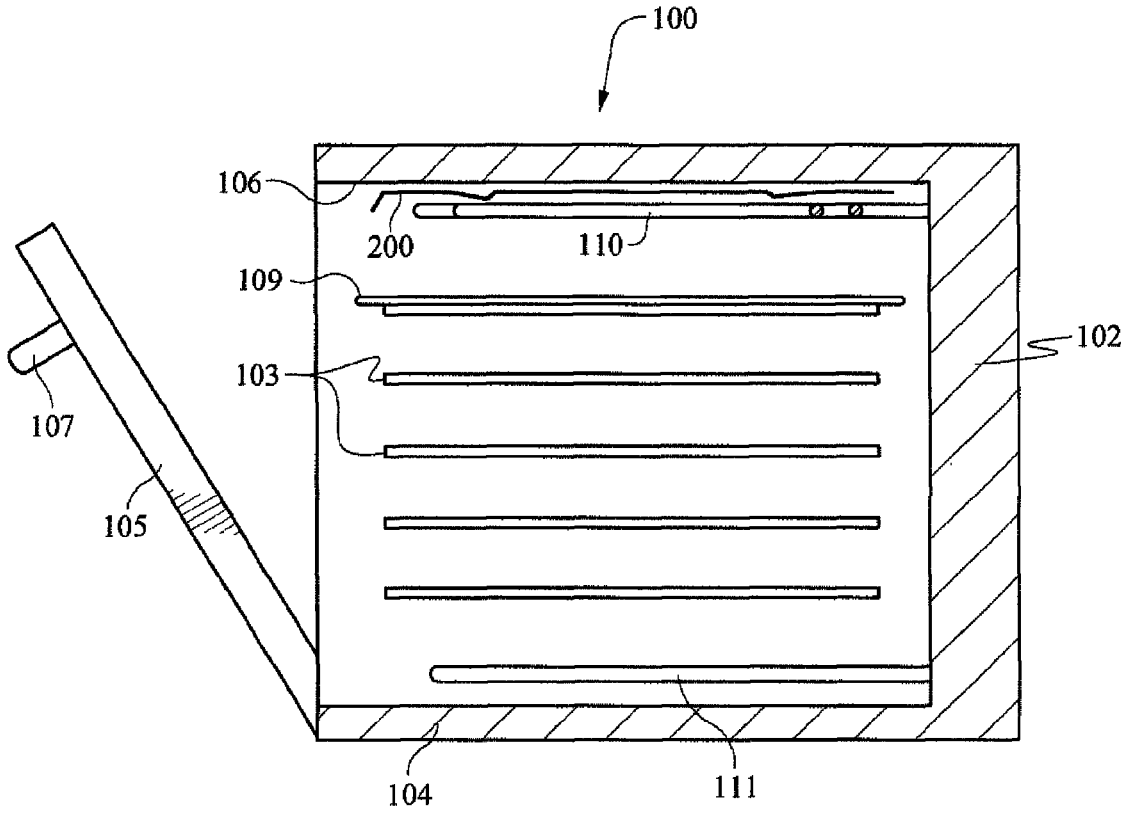
FIG. 3 is a cross-sectional view of the interior of a residential oven which includes a broiler shield.

FIG. 3 illustrates a residential oven 100 which includes a broiler heating element 110 as illustrated in FIG. 2A or 2B. A broiler shield 200 is mounted between the broiler heating element 110 and the upper wall 106 of the cooking cavity of the oven. As will be explained in greater detail below, the broiler shield 200 acts to reflect radiant energy emitted upwards and sideways by the broiler heating element back down onto food items located on an underlying rack. The shape of the broiler shield is designed to reflect the radiant energy emitted by the broiler heating element 110 so as to promote more even heating and browning of the underlying food items.

Figure 4B:
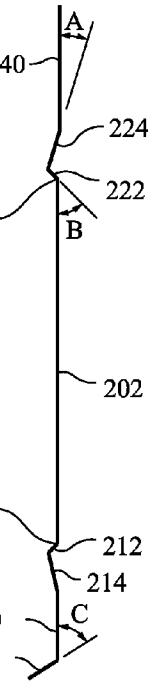
FIGS. 4A and 4B are plan and side views of a broiler shield.
Figure 4A:
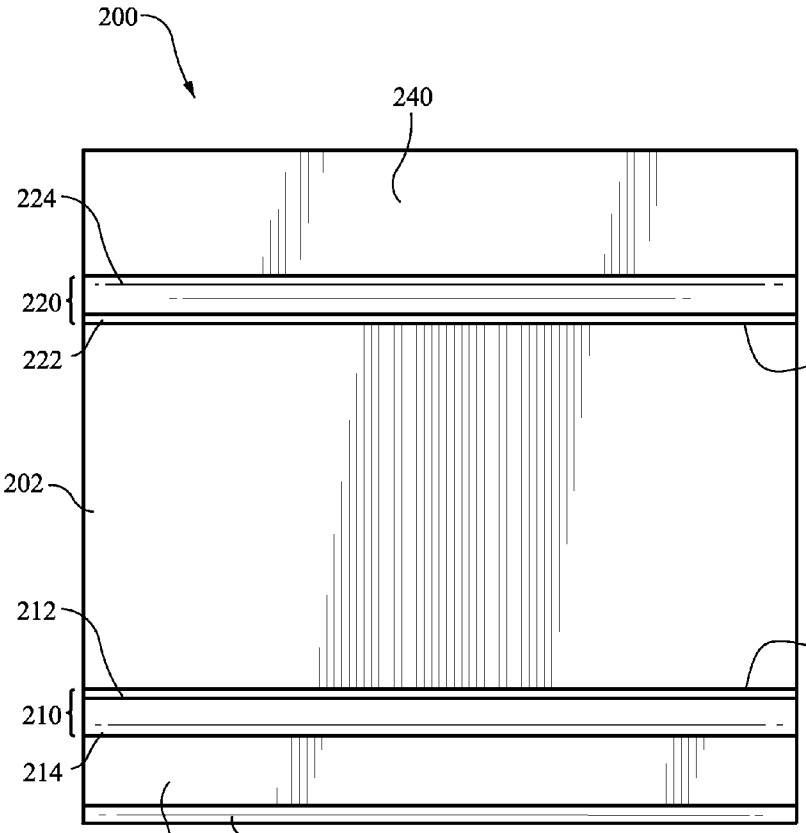

FIGS. 4A and 4B illustrate a first embodiment of a broiler shield 200 which can be used in a residential oven. As shown in FIGS. 4A and 4B, the broiler shield 200 includes a large planar central portion 202. A front reflecting portion 210 extends forward from a forward edge 203 of the central portion 202. A rear reflecting portion 220 extends rearward from a rearward edge 205 of the central portion 202. As best illustrated in FIG. 4B, the front reflecting portion 210 includes a first reflector 212 which extends forward and downward from a front edge of the central portion 202. The front reflecting portion 210 also includes a second reflector 214 which extends upward and forward from a front edge of the first reflector 212.

As also illustrated in FIG. 4B, the rear reflecting portion 220 includes a first reflector 222 which extends downward and rearward from a rear edge of the central portion 202. In addition, the rear reflecting portion 220 also includes a second reflector 224 which extends upward and rearward on the rear edge of the first reflector 222.

As also illustrated in FIG. 4B, a first acute angle A is formed between a plane of the central portion 202 and a plane of the second reflector 224. Further, an acute angle B is formed between the plane of the central portion 202 and the plane of the first reflector 222 of the rear reflecting portion. Acute angles are also formed between the plane of the central portion 202 and the plane of the first reflector 212 and second reflector 214 of the front reflecting portion 210. In some embodiments, the same acute angle A is formed between the plane of the central portion 202 and the plane of the second reflecting portion 214 of the front reflecting portion 210. Likewise, the same acute angle B is formed between the plane of the central portion 202 and the plane of the first reflector 212 of the front reflecting portion 210.

In some embodiments, the acute angle A is approximately 15°, and the acute angle B is approximately 30°.

The broiler shield also includes a front extension which extends forward from a front edge of the second reflector 214 of the front reflecting portion 210. The front extension includes a planar portion 230 and a front reflector 232. The plane of the planar portion 230 is approximately parallel to a plane of the central portion 202.

An acute angle C is formed between the plane of the planar portion 230 and a plane of the front reflector 232. In some embodiments, the acute angle C is approximately 60°.

The broiler shield further includes a rear extension 240 which extends rearward from the second reflector 224 of the rear reflecting portion 220. The plane of the rear extension 240 is approximately parallel to the plane of the central portion 202.

Figure 5B:
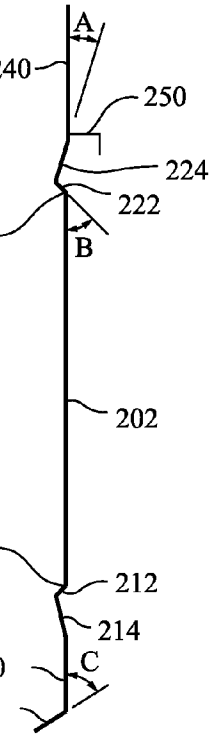
FIGS. 5A and 5B are plan and side views of another embodiment of a broiler shield.
Figure 5A:
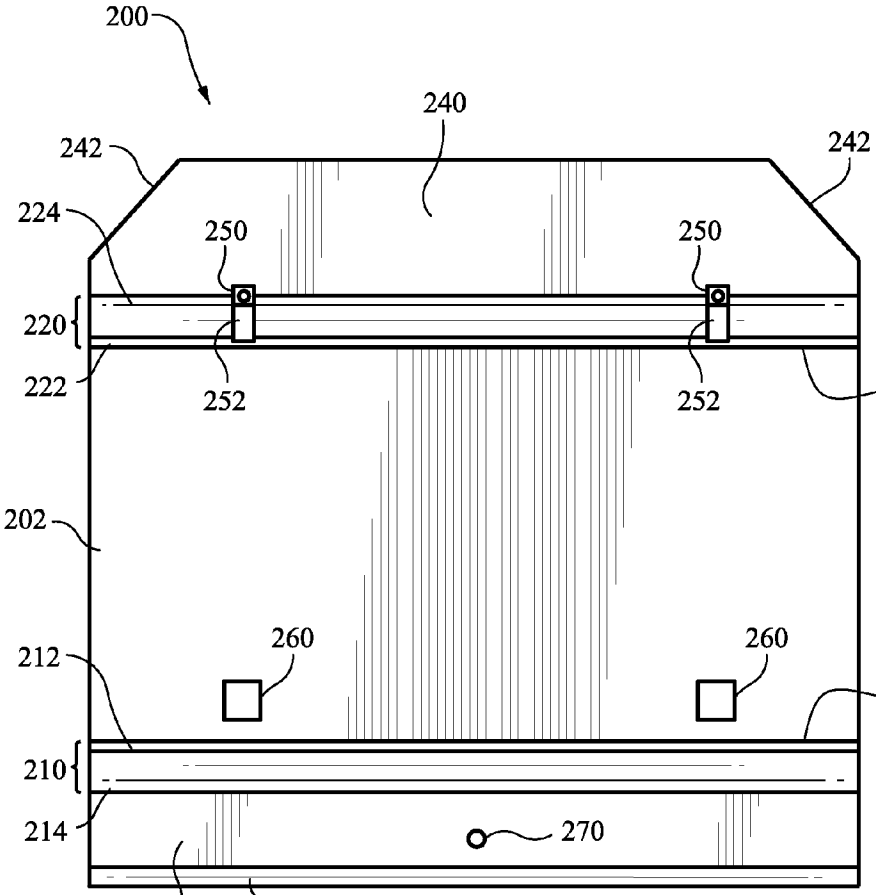

FIGS. 5A and 5B illustrate an alternate embodiment of a broiler shield. This embodiment is similar to the embodiment illustrated in FIGS. 4A and 4B, but includes additional features. Specifically, the embodiment illustrated in FIGS. 5A and 5B includes apertures 260 which are used to help mount a broiler heating element to the interior of a residential oven. This is explained in greater detail below.

In addition, mounting elements 250 are provided towards the rear of the broiler reflector. The mounting elements 250 comprise portions of the plate of material forming the broiler reflector which have been cut and bent upward. As illustrated in FIG. 5B the mounting elements 250 end up having an L-shape. As will be explained in further detail below, the mounting elements 250 are used to help mount the broiler reflector 200 to the upper wall of an oven.

The embodiment illustrated in FIGS. 5A and 5B also includes two beveled portions 242 on the side edges of the rear extension 240. The beveled portions 242 can help to conform the broiler reflector to the shape of the interior of an oven cavity.

The embodiment illustrated in FIGS. 5A and 5B further includes a mounting hole 270 formed in the planar portion 240 of the front extension. The mounting hole 270 is also used to facilitate mounting of the broiler reflector to the upper wall of an oven cavity.

Figure 6:
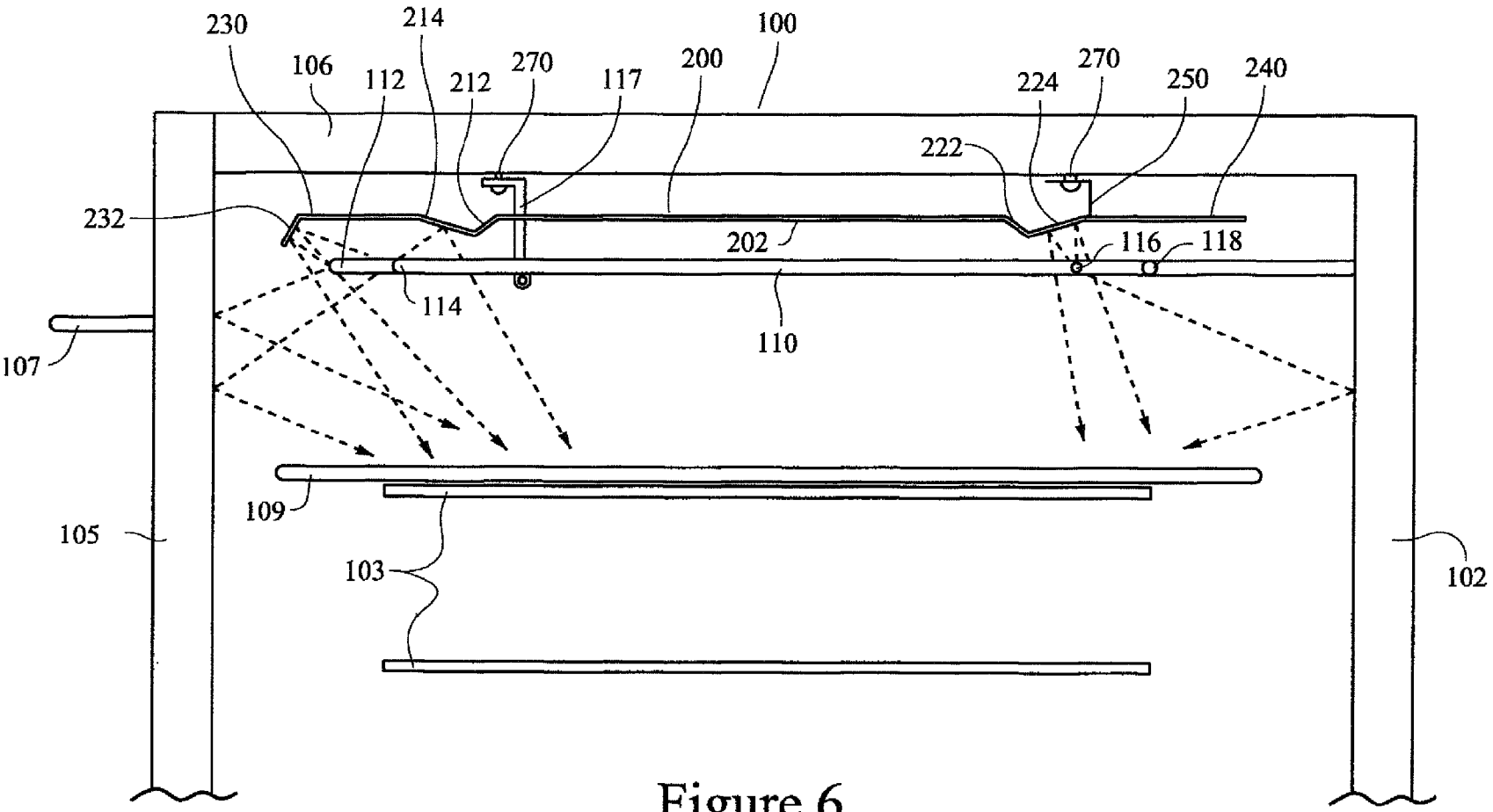
FIG. 6 is a partial cross-sectional view of the interior of a residential oven which includes a broiler shield.

FIG. 6 shows a broiler reflector 200 mounted to the upper wall 106 of a residential oven 100. The broiler reflector 200 is located between the upper wall 106 and a broiler heating element 110. The broiler reflector is similar to the embodiment illustrated in FIGS. 5A and 5B.

As illustrated in FIG. 6, mounting elements 117 project upward from the broiler heating element 110, they pass through the apertures 260 in the broiler reflector, and they are attached to the upper wall 106 of the oven 100 by fasteners 270. The mounting elements 250 on the broiler reflector project upward from the broiler reflector 200 and they are attached to the upper wall 106 of the oven 100 by fasteners 270.

As explained with reference to FIG. 2A, the broiler heating element 110 includes straight portions 113 which extend between front portions 112, 114 and rear portions 116. A connecting portion 118 extends rearward to attach the broiler heating element 100 to a power supply. The connecting portion also serves to mount the rear portion of the broiler heating element 110 to the rear wall of the oven.

The rear portions 116 which connect straight portions 113 of the broiler heating element 110 emit radiant energy. Likewise, the front portions 112 and 114 which also connect the straight portions 113 of the broiler heating element 110 also emit radiant heat energy. The dashed lines in FIG. 6 show the travel path of some of the radiant heat energy emitted by the front portions 112, 114 and rear portions 116. The dashed lines also illustrate how the radiant energy is reflected by various portions of the broiler shield 200.

Applicants believe that the radiant heat energy emitted upward and forward from the front portions 112, 114 of the broiler heating element are reflected downward and rearward by front reflector 232 of the broiler shield 200. This radiant energy, which would otherwise not reach the underlying rack 109, is instead directed down onto the front portions of the underlying rack 109.

Likewise, radiant heat energy emitted upward and rearward from the front portions 112, 114 of the broiler heating element are reflected downward and rearward by the second reflector 214 of the front reflecting portion of the broiler shield 200. Because the second reflector 214 is angled relative to the plane of the central portion 202 of the broiler shield, radiant energy reflected by the second reflector 214 is directed further toward the front of the underlying rack 109 than would be the case if the broiler shield were simply planar along its entire length.

Radiant energy emitted upward and forward by the rear portions 116 of the broiler heating element 110 is reflected downward by the second reflector 224 of the rear reflecting portion of the broiler shield. And because the second reflector 224 of the rear reflecting portion is also angled relative to the central portion 202 of the broiler shield, this radiant energy is reflected further toward the rear of the underlying rack than would be the case if the rear reflector 224 was not angled.

When no broiler shield is provided, or when a simple planer broiler shield is provided, more heat and radiant energy from the broiler heating element tends to reach the central portion of the underlying rack than the front and rear portions of the underlying rack. Thus leads to uneven cooking and browning of food items on the underlying rack.

However, when a broiler shield as illustrated in FIGS. 4A, 4B, 5A and 5B is mounted above a broiler heating element, portions of the radiant energy emitted by the broiler heating element that would otherwise be lost, or which would otherwise be reflected onto central portions of the underlying rack is instead redirected to the front and rear portions of the underlying rack. This leads to more even cooking and browning of food items on the underlying rack.

The relative positions of the front and rear reflecting portions could vary depending on the shape and configuration of the broiler heating elements. However, Applicants presently believe that it is most advantageous if the front reflecting portion and rear reflecting portions of the broiler shied are positioned more toward the center of the oven than the front and rear portions of the broiler heating elements which join the straight portions of the heating elements.

Figures 7A, 7B:
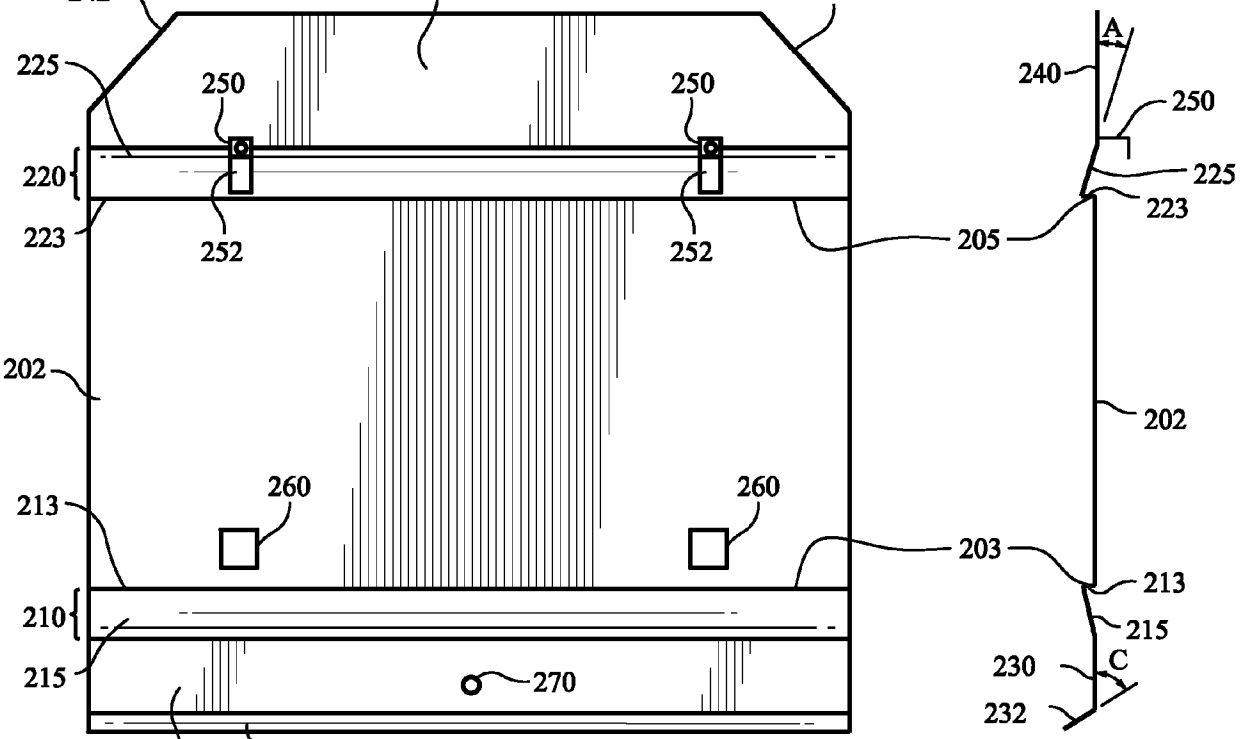
FIGS. 7A and 7B are plan and side views of another embodiment of a broiler shield.

FIGS. 7A and 7B illustrate yet another embodiment of a broiler shield. In this embodiment, the front reflecting portion 210 includes a first section 213 that extends downward from the front edge of the central portion 202 at approximately a 90° angle. A reflector 215 then extends forward and upward to the rear edge of the planar portion 230 of the front extension. Likewise, the rear reflecting portion 220 includes a first section 223 that extends away from the rear edge of the central portion 202 at approximately a 90° angle. A reflector 225 then extends rearward and upward to the front edge of the rear extension 240.

In this embodiment, because the first sections 213, 223 extends away from the central portion 202 at a right angle, the reflectors 215, 225 have a greater surface area than the second reflectors 214, 224 in the embodiments in FIGS. 4A, 4B, 5A and 5B. The larger surface area of the reflectors 215, 225 in the embodiment illustrated in FIGS. 7A and 7B cause a greater amount of the radiant energy emitted upward from the broiler heating element to be reflected back toward the front and rear portions of an underlying rack, as compared to the embodiments illustrated in FIGS. 4A, 4B, 5A and 5B.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A broiler shield for a residential oven, the broiler shield being configured to be mounted between an upper wall of a heating cavity of the residential oven and a broiler heating element located at the top of the heating cavity, and which when so mounted in an oven, comprises:

a substantially flat central portion;

a front reflecting portion that extends downward from a front edge of the central portion, the front reflecting portion including:

a first section that extends downward from the front edge of the central portion, and a second section that extends upward and forward from the first section;

a rear reflecting portion that extends downward from a rear edge of the central portion, the rear reflecting portion including:

a first section that extends downward from the rear edge of the central portion, and a second section that extends upward and rearward from the first section.

2. The broiler shield of claim 1, wherein the first section of the first reflecting portion and the first section of the second reflecting portion extend downward from the central portion at approximately a right angle to the central portion.

3. The broiler shield of claim 1, wherein the first section of the first reflecting portion extends forward and downward from the front edge of the central portion, and wherein the first section of the second reflecting portion extends downward and rearward from the rear edge of the central portion.

4. The broiler shield of claim 3, wherein an acute angle formed between a plane of the central portion and a plane of the first section of the front reflecting portion is approximately equal to an acute angle formed between the plane of the central portion and a plane of the first section of the rear reflecting portion.

5. The broiler shield of claim 4, wherein the acute angle formed between the plane of the central portion and planes of the first sections of the front and rear reflecting portions is approximately 30°.

6. The broiler shield of claim 4, wherein an acute angle formed between the plane of the central portion and a plane of the second section of the front reflecting portion is approximately equal to an acute angle formed between the plane of the central portion and the plane of the second section of the rear reflecting portion.

7. The broiler shield of claim 6, wherein an acute angle formed between the plane of the central portion and the planes of the second sections of the front and rear reflecting portions is approximately 15°.

8. The broiler shield of claim 6, wherein the acute angle formed between the plane of the central portion and planes of the first sections of the front and rear reflecting portions is approximately twice as large as the acute angle formed between the plane of the central portion and the planes of the second sections of the first and second reflecting portions.

9. The broiler shield of claim 8, wherein the acute angle formed between the plane of the central portion and planes of the first sections of the front and rear reflecting portions is approximately 30°, and wherein the acute angle formed between the plane of the central portion and the planes of the second sections of the first and second reflecting portions is approximately 15°.

10. The broiler shield of claim 1, further comprising a front extension that extends forward from a front edge of the front reflecting portion, the front extension comprising:

a planar portion that extends forward from a front edge of the front reflecting portion; and a front reflector that extends downward and forward from a front edge of the planar portion.

11. The broiler shield of claim 10, wherein an acute angle formed between a plane of the central portion and a plane of the front reflector is approximately 60°.

12. The broiler shield of claim 1, further comprising a plurality of apertures formed in the broiler shield, wherein the apertures allow mounting elements connected to a broiler heating element located under the broiler shield to pass through the apertures so that they can be attached to an upper wall of a residential oven located above the broiler shield.

13. The broiler shield of claim 1, further comprising a plurality of mounting elements that extend upward from the broiler shield and that are configured to couple the broiler shield to an upper wall of a cooking cavity of a residential oven.

14. The broiler shield of claim 13, wherein the mounting elements comprise portions of the broiler shield that have been cut and bent upward relative to the central portion.

15. A residential oven, comprising a heating cavity having an upper wall;

a broiler shield mounted to the upper wall, the broiler shield comprising:

a substantially flat central portion;

a front reflecting portion that extends downward from a front edge of the central portion, the front reflecting portion including:

a first section that extends downward from the front edge of the central portion, and a second section that extends upward and forward from the first section;

a rear reflecting portion that extends downward from a rear edge of the central portion, the rear reflecting portion including:

a first section that extends downward from the rear edge of the central portion, and a second section that extends upward and rearward from the first section; and a broiler heating element mounted under the broiler shield.

16. The residential oven of claim 15, wherein the front and rear reflecting portions of the broiler shield reflect radiant heat that projects upward from front and rear portions of the broiler heating element downward and towards front and rear portions, respectively, of an underlying oven rack.

17. The residential oven of claim 16, wherein the broiler shield further comprises a front extension that extends forward from a front edge of the front reflecting portion, the front extension comprising:

a planar portion that extends forward from a front edge of the front reflecting portion; and a front reflector that extends downward and forward from a front edge of the planar portion, wherein the front reflector reflects radiant heat that projects upward and forward from front portions of the broiler heating element downward towards the front portion of an underlying oven rack.

18. The residential oven of claim 16, wherein the front reflecting portion and rear reflecting portion of the broiler shield are located closer to a center of the oven than front and rear portions of the broiler heating element that join straight portions of the heating element.

* * * * *